US007337859B2

(12) United States Patent
Völkel et al.

(10) Patent No.: US 7,337,859 B2
(45) Date of Patent: Mar. 4, 2008

(54) METHOD AND DEVICE FOR DRILLING A CHANNEL

(75) Inventors: Gerhard Völkel, Erndtebrück (DE); Andreas Riekes, Schmallenberg (DE)

(73) Assignee: Tracto-technik GmbH, Lennestadt (DE)

( * ) Notice: Subject to any disclaimer, the term of this patent is extended or adjusted under 35 U.S.C. 154(b) by 159 days.

(21) Appl. No.: 10/537,554

(22) PCT Filed: Dec. 5, 2003

(86) PCT No.: PCT/EP03/13789

§ 371 (c)(1),
(2), (4) Date: Jun. 28, 2005

(87) PCT Pub. No.: WO2004/053285

PCT Pub. Date: Jun. 24, 2004

(65) Prior Publication Data

US 2006/0060383 A1 Mar. 23, 2006

(30) Foreign Application Priority Data

Dec. 6, 2002 (DE) ..... 102 57 392

(51) Int. Cl.
*E21B 7/04* (2006.01)

(52) U.S. Cl. ..... 175/53; 175/62; 405/154.1

(58) Field of Classification Search ..... 175/53, 175/62; 405/138, 154.1, 174, 303
See application file for complete search history.

(56) References Cited

U.S. PATENT DOCUMENTS

| | | | | |
|---|---|---|---|---|
| 1,894,446 | A * | 1/1933 | McKenny | 173/112 |
| 3,451,491 | A * | 6/1969 | Clelland | 173/44 |
| 3,469,638 | A * | 9/1969 | Atkins et al. | 175/53 |
| 4,422,800 | A * | 12/1983 | Parish | 405/184 |
| 4,679,637 | A | 7/1987 | Cherrington et al. | |
| 4,694,913 | A * | 9/1987 | McDonald et al. | 175/61 |
| 5,282,696 | A * | 2/1994 | Solomon et al. | 405/184 |
| 6,112,833 | A * | 9/2000 | Lambert | 175/62 |
| 6,171,026 | B1 * | 1/2001 | Crane et al. | 405/156 |
| 6,682,264 | B1 * | 1/2004 | McGillis | 405/184 |
| 2003/0076106 | A1 * | 4/2003 | Mercer | 324/326 |

FOREIGN PATENT DOCUMENTS

CA 1 024 503 A 1/1978

* cited by examiner

*Primary Examiner*—David Bagnell
*Assistant Examiner*—Daniel P Stephenson
(74) *Attorney, Agent, or Firm*—Henry M. Feiereisen; Ursula B. Day

(57) ABSTRACT

In a drilling method for creating a channel leading from surrounding soil into a shaft which is separated from the soil by a wall, a channel is drilled through the soil from a starting pit in the direction of the shaft using a first drill head. The first drill head continues to drill in this direction in order to create a breach in the wall, and a second drill head is then used in the shaft to widen the breach in the wall by drilling in the opposite direction with the second drill head.

5 Claims, 6 Drawing Sheets

METHOD AND DEVICE FOR DRILLING A CHANNEL

BACKGROUND OF THE INVENTION

The invention relates to a method and a device for drilling a channel that leads from the soil into a shaft surrounded by a wall, the invention claiming priority of German patent application 102 57 392.1, to whose content reference is made.

Two different methods for installing house service connections are described in DE 198 20 483 C1. First, a method is described in which a controllable drill head is used to establish a channel for a house service connection from a starting pit, located outside the house, to a target pit adjacent to the outside of the outer wall of the house. The breach in the outer wall is produced with a separate concrete drill device such as a drill hammer or drill saw.

DE 198 20 483 C1 describes an innovation in the form of a method in which a breach is first made through the outer wall from the direction of the inside of the house, using a drill bit to drill through the concrete outer wall, and, after a change of tools, a channel for a house service connection is established, in the soil surrounding the house, using a drill head whose course is controlled.

Both methods are complicated. In one method, difficult excavation work has to be carried out to form a target pit, and, in the second method, the entire equipment needed to drive the drill head forward on a controlled course has to be accommodated in the house cellar.

SUMMARY OF THE INVENTION

Therefore, the object here is to make available a method which is easy to carry out and creates a channel leading from the soil into a shaft surrounded by a wall, and also to make available a device suitable for this method.

The invention is based on the concept of initially using a first drill head to create a channel leading from the starting pit into the shaft, the drill head preferably being designed in such a way that it can both create a channel in the soil and also breach a wall. In most cases, the breach created in this way in the wall has, in its emergence area, an uneven and often arbitrary shape. For connection of channel pipes, it is generally necessary to re-work this breach in the wall. It is therefore proposed, according to the invention, to replace the first drill head with a second drill head on the drilling device used, and to drill counter to the original direction of advance, at least for the area of the masonry. Thus, by suitable choice of the second drill head, a breach with the desired shape and size can be created in the wall.

The method according to the invention further affords the advantage that a wall breach of small cross section can first of all be created in the wall by means of the first drill head. This breach can be created with less torque than in the case of a large breach. The subsequent widening of the breach in the wall to a larger cross section can then likewise be done with less torque. Thus, in the method according to the invention, a drilling device can be used which generates only a low maximum torque.

The method according to the invention also affords the advantage, for example in use in sewage shafts, that a breach in the shaft wall can be created without using an explosion-proof drill driver inside the shaft. The components introduced into the shaft can then pose no risk of explosion.

Breaches in shaft walls or room walls must in some cases be lined with specific sealing materials. In most cases, the breach in the wall itself therefore has to have a larger cross section than the pipe that is to be guided through the breach. With the method according to the invention, it is now possible to create an earth channel of small cross section adapted to the pipe to be passed through, and only to widen the wall breach to the cross section adapted for the additional materials that are to be introduced. In this way, it is possible to avoid forming the entire earth channel with a cross section larger than is necessary for the pipe.

The present invention can be used to create a channel leading from the soil into a shaft surrounded by a wall. A channel is understood as meaning, in particular, any free space created in a more solid environment by drilling equipment. In particular, a channel is a free space with a round cross section. The channel can be used to receive pipelines, cables and other elongate bodies. For example, reinforcements can also be introduced into the channel. Likewise, the channel can be filled with a solid or solidifying material, for example in order to strengthen the more solid environment.

A shaft is understood as meaning a free space which is surrounded by a wall and which has channels leading to and away from it. In particular, a shaft is a connection shaft for pipelines, for example of the kind installed under streets, for example for removing waste water or for guiding gas conduits, telecommunication lines and other forms of communication lines. A shaft within the meaning of this invention is also understood, in particular, as including a space in a house, in particular a cellar.

Soil is understood in the general sense of this word, but, for the purposes of the present invention, also as an area underneath the soil surface which has liquid or unfilled sections, and any solid, pourable or viscous material underneath the soil surface or in comparable composition and arrangement above the soil surface.

A wall is understood in particular as any piling of material created specifically to delimit the shaft. In particular, a wall is also intended to include masonry formed from assembled individual parts, for example stones. A wall may also be a room boundary cast from a material such as concrete or plastic, for example.

For the purposes of illustrating this invention, a starting pit can also be a starting position on the soil surface.

According to the invention, the channel to be created is initially produced from a starting pit using a first drill head which is driven forward in the direction of the target shaft. The starting pit can in this case be a specially excavated pit. However, the starting pit used can also be, for example, another shaft (starting shaft).

Particularly when drilling from a starting shaft, it may be expedient first of all to use another drill head to breach a wall surrounding said shaft.

The creation of the channel by means of the first drill head takes place in particular according to the horizontal drilling methods that are well known in practice. In this case, the first drill head can be designed to move forward by itself, for example, or to be driven forward by a rod. The first drill head can be a controllable drill head, for example with an asymmetrical drill head geometry and a control surface. It can be designed as a percussion drill head. The drill head preferably has adapters for receiving a pipe that is to be introduced into the channel to be created, so that the pipe is drawn by the forwardly driven drill head directly into the channel formed.

Forward drilling is particularly preferred, preferably using drill heads with a front cutter geometry.

On reaching the outer face of the wall surrounding the shaft, the drill head is driven further forward and creates a breach through the masonry.

The first drill head can then be replaced or supplemented in the shaft by a second drill head. In the case of a drill head driven by rods, the first drill head can be released from the drill rod, and the second drill head can be connected to the rod. In this case, the second drill head is preferably designed in such a way that it is suitable for drilling by being pulled by a rod. The second drill head can then be driven forward through the breach in the wall, counter to the direction in which the first drill head was driven through, and in so doing it is able to widen this breach. Widening is understood in particular as an enlargement of the cross section. However, widening, within the meaning of the invention, can also include the re-working of the peripheral edges of the breach in the wall. These edges can be smoothed by grinding, or the shape of the breach in the wall can be re-worked or leveled out. This leveling-out is necessary, in particular, if prefabricated connection elements are intended to be inserted into the breach in the wall.

A core hole drill is preferably used as the second drill head. The drilling in the opposite direction with the second drill head is preferably terminated upon reaching that surface of the wall located toward the outside in relation to the interior of the shaft. In this way, the drilling with the second drill can be reduced, thus resulting, in particular, in savings both in time and energy. However, the drilling with the second drill head can be terminated even before reaching that surface of the wall located toward the outside in relation to the interior of the shaft, for example if only that area of the wall breach lying to the inside of the shaft is to be re-worked. Likewise, the drilling with the second drill head can also be terminated well behind that surface of the wall located toward the outside in relation to the interior of the shaft, for example if a connection element extending beyond the wall cross section is to be inserted into the breach in the wall.

The second drill head is recovered in a simple way by being guided back into the shaft upon termination of the drilling with the second drill head.

Targeted guidance of the drill head, in particular for aiming it precisely at the point where the wall breach is to be created, is achieved if a transmitter on the first drill head and/or a further transmitter on the second drill head emits a position signal, and the drilling parameters are regulated as a function of the position signal received by a receiver.

One drilling parameter is, in particular, the orientation of an asymmetrical drill head provided with a control surface.

The breach in the wall enlarged by the second drill head is preferably lined. In this way, for example, the pipe inserted into the shaft can be insulated or can be connected to the wall. Moreover, connection pieces or prefabricated pipe attachments, for example, can be inserted into the enlarged breach in the wall.

According to the invention, a drilling system is also proposed, in particular for carrying out the aforementioned method, comprising a drill slide, a drill rod and two drill heads, in which the first drill head is designed to advance by being pushed by the rod, and the second drill head is designed to advance by being pulled by the rod, said second drill head being designed to create a larger cross section of the drilled hole.

According to the invention, a drill slide is understood in particular as any drive unit for a drill head designed to drive the drill head forward. In particular, a drill slide comprises a pusher unit which can be connected to a free end of a drill rod section and with which the drill rod section can be driven forward.

In order to provide a smooth edge when drilling through masonry, the second drill head is preferably designed with a large number of contact points on the drilling surface. Contact points are understood here as points on the drilling surface which are formed protruding therefrom and which are first to come into engagement with the material that is to be drilled through. With an increasing number of these contact points, the force applied by the drill head into the material to be drilled through is distributed to a plurality of points. This prevents substantial forces being applied at a small number of points, which would otherwise cause spalling. Spalling is understood as meaning when, during drilling, large pieces of material split off from the material that is to be drilled through.

BRIEF DESCRIPTION OF THE DRAWING

The invention is explained in more detail below with reference to a drawing. Illustrative embodiments of the invention are set out in this drawing, in which.

DETAILED DESCRIPTION OF PREFERRED EMBODIMENTS

Figure 1:
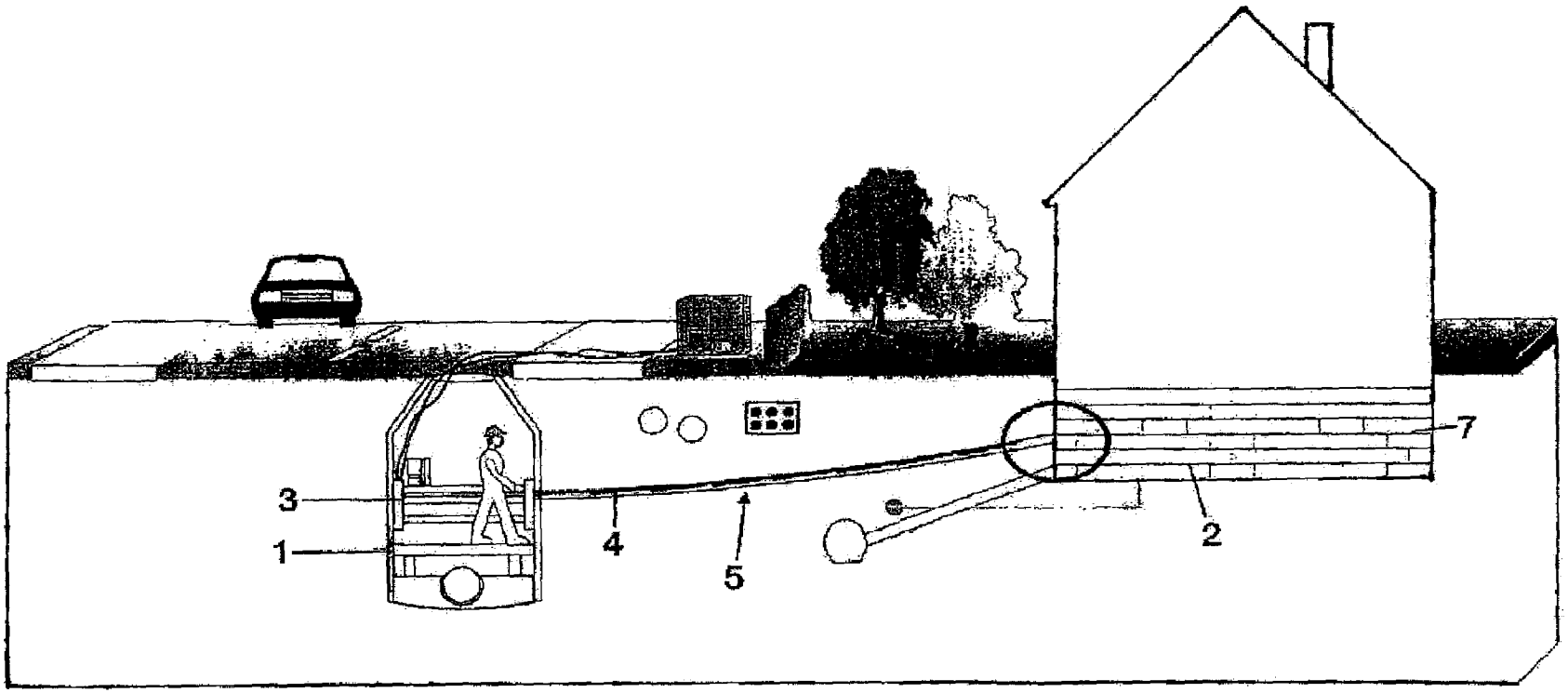
FIG. 1 shows a schematic representation of the means used to carry out the method according to the invention.

A starting shaft 1 and a cellar 2, which represents the target shaft, are shown in FIG. 1. A drill slide 3 is arranged in the starting shaft 1. With this drill slide 3, rod sections 4 are pushed into the channel 5 created in the soil surrounding the starting shaft 1. The rod sections 4 are connected to one another. As can be seen from FIG. 2, the frontmost rod section 4 is connected to a drill head 6. A torque can be applied to the drill head 6 by the rod sections 4, and said drill head 6 can be rotated about the forward drive axis.

Figure 2:
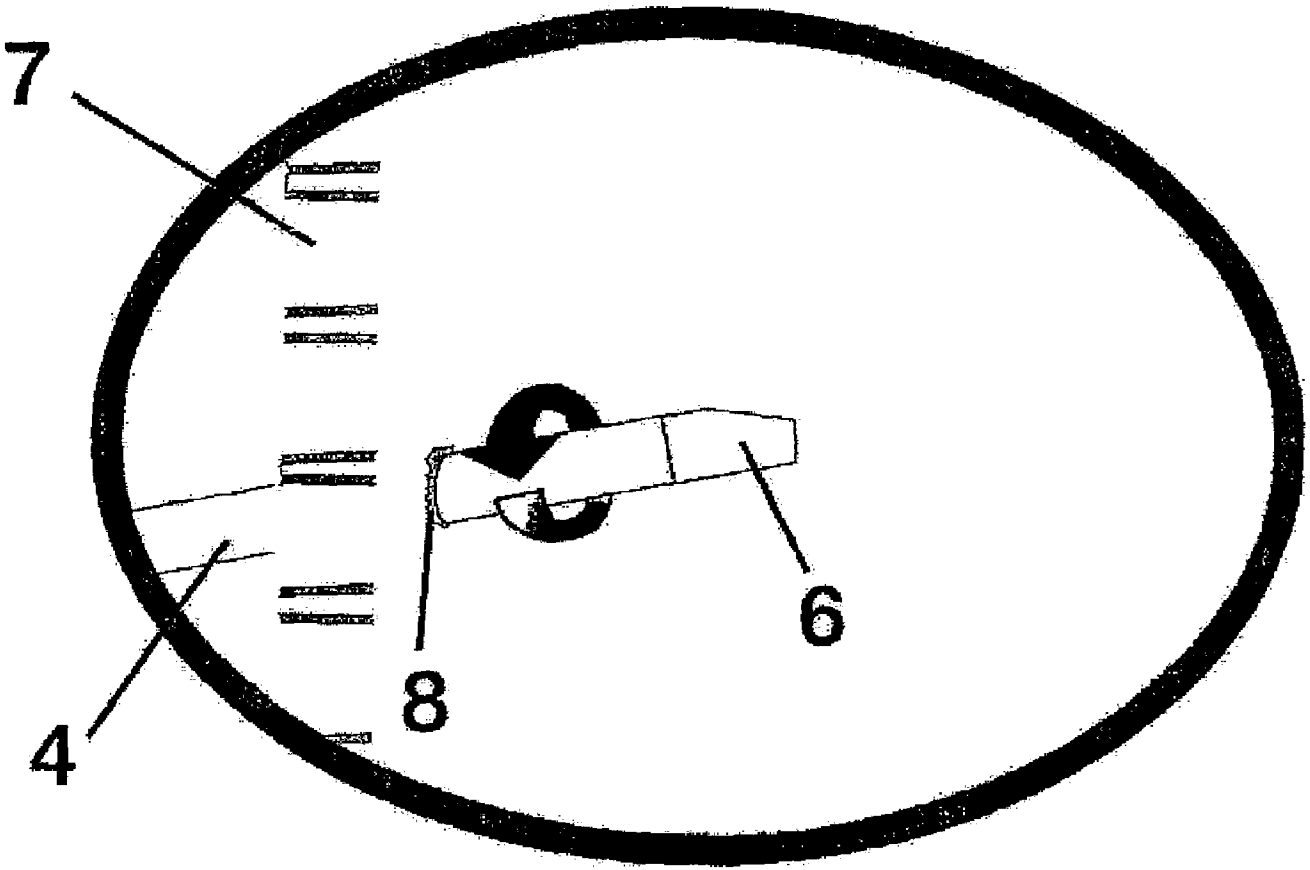
FIG. 2 shows an enlarged representation of the detail indicated in FIG. 1.
Figure 3:
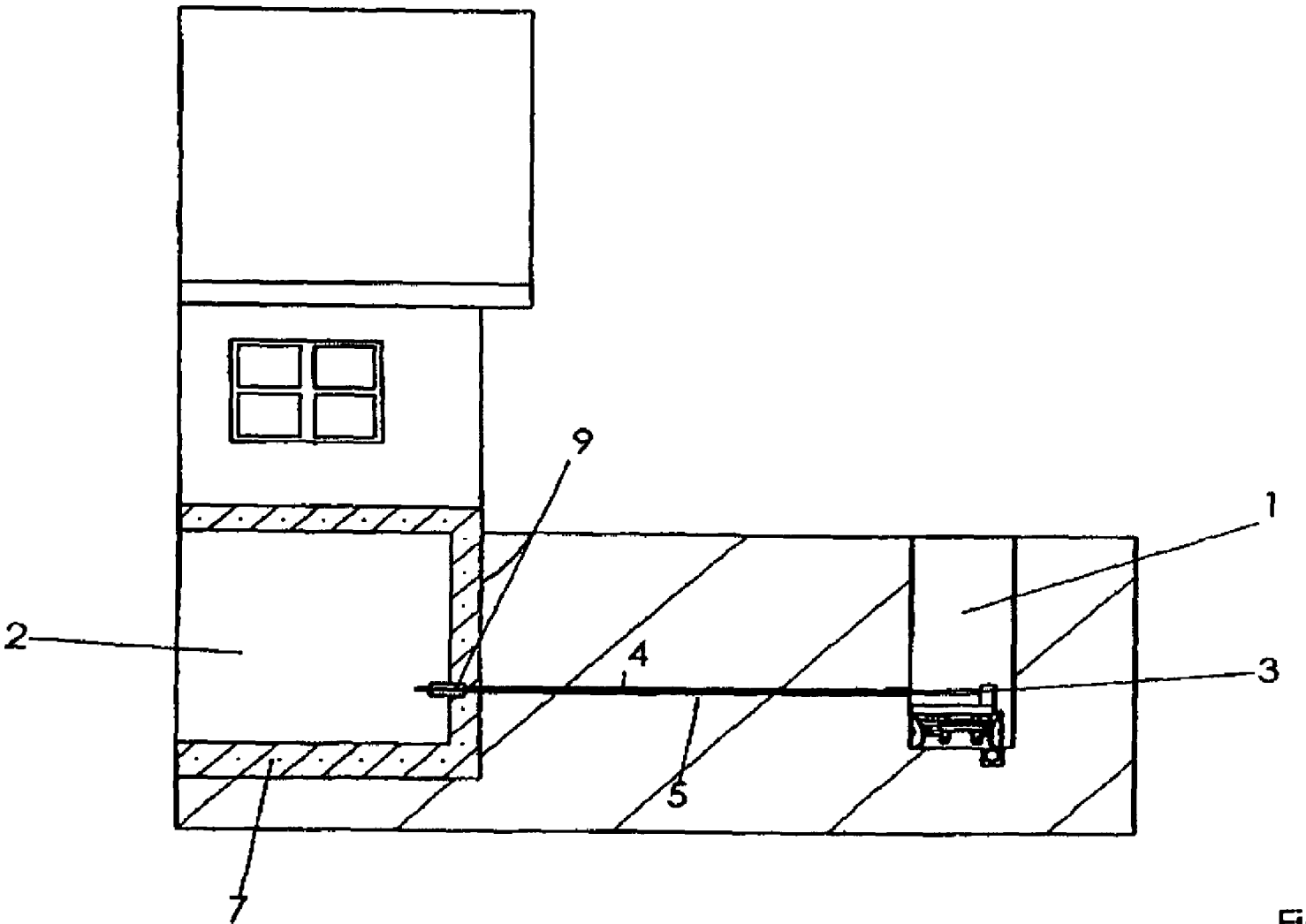
FIG. 3 shows a cutaway side view of core hole drilling as part of the method according to the invention.

To create the channel 5 between the starting shaft 1 and the cellar 2, the drill head is driven into the soil surrounding the starting shaft 1, by means of the rod sections 4 driven by the drill slide 3, and it creates the channel 5 in said soil. Upon reaching the surface of the wall 7 located toward the outside in relation to the cellar, the drill head 6 is driven further forward and creates the breach 8 in the wall as shown in FIG. 2. This breach exhibits irregularities of shape and spalling. Following the first breach of the wall 7, the drill head 6 is replaced in the cellar by a drill head 9. The latter is designed to create a smooth drilled hole in a wall and is able to produce a wall breach having a greater cross section than the wall breach created with the drill head 6. This drill head 9 is guided by pulling the rods back in the direction of advance counter to that of the first drill head 6, and it creates, in the wall 7, a breach with a regular shape and with the desired cross section (cf. FIG. 3).

Figure 4:
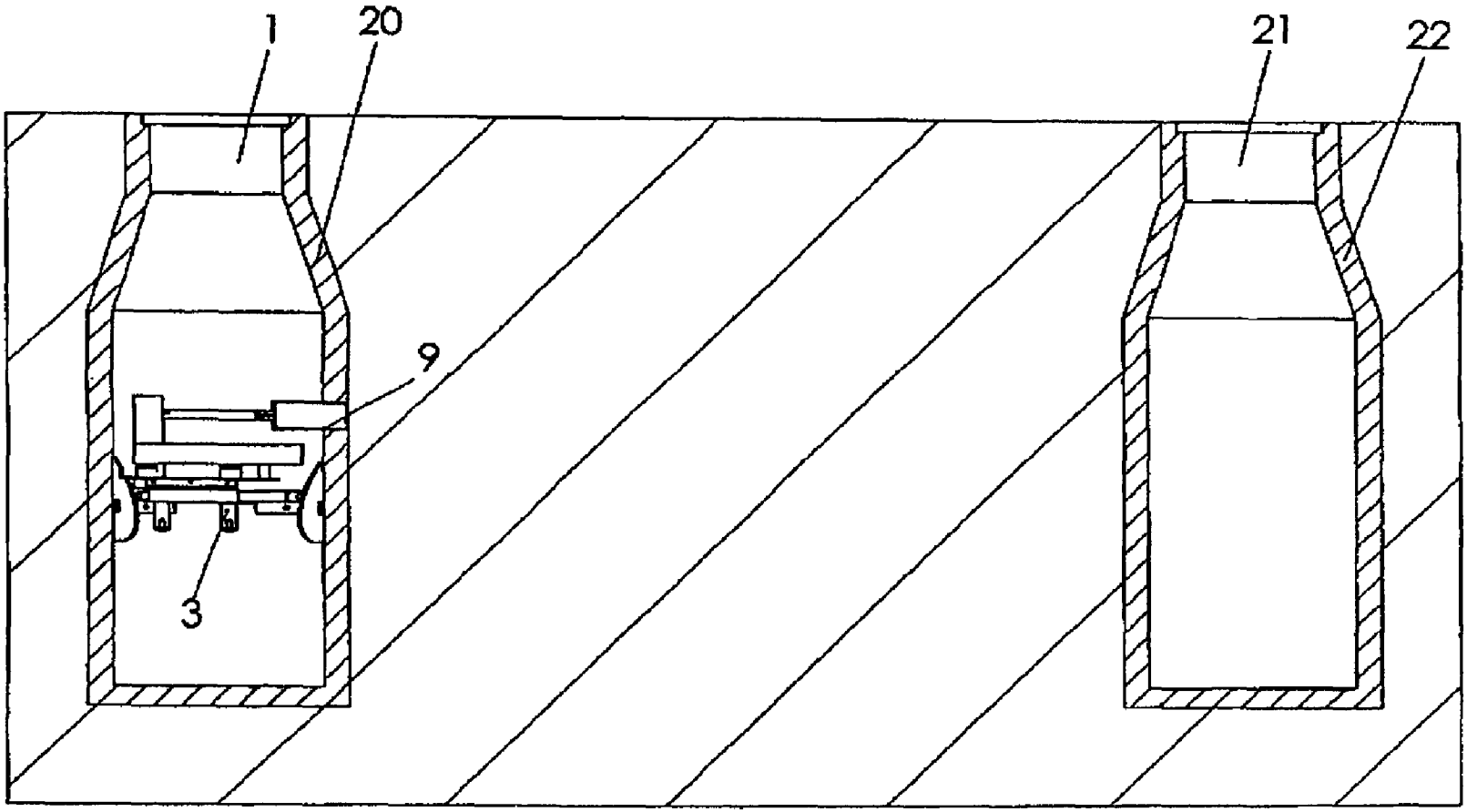
FIG. 4 shows a cutaway side view of a first method step in a further embodiment of the method according to the invention.
Figure 5:
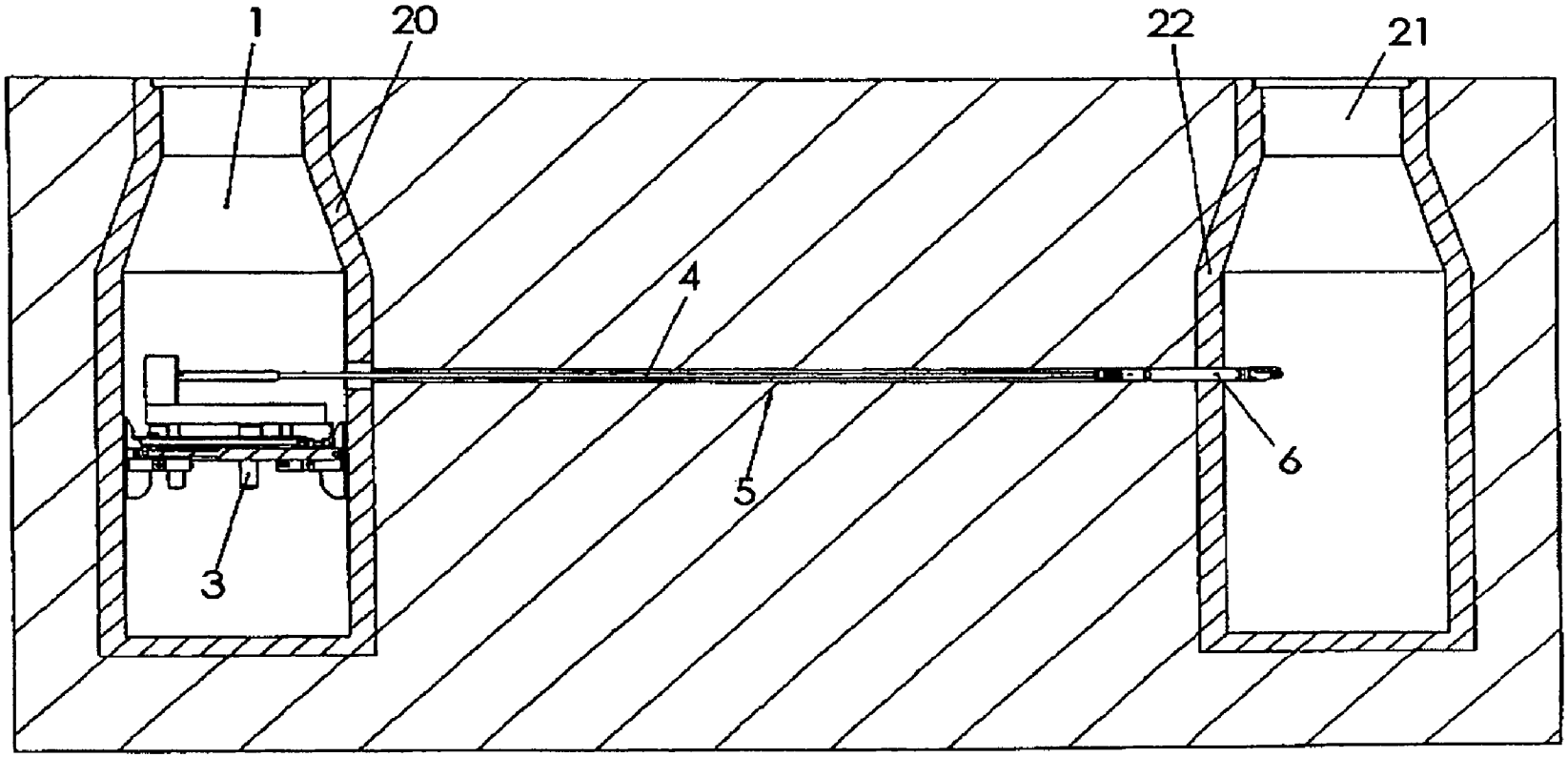
FIG. 5 shows a cutaway side view of a second method step in the further embodiment of the method according to the invention.
Figure 6:
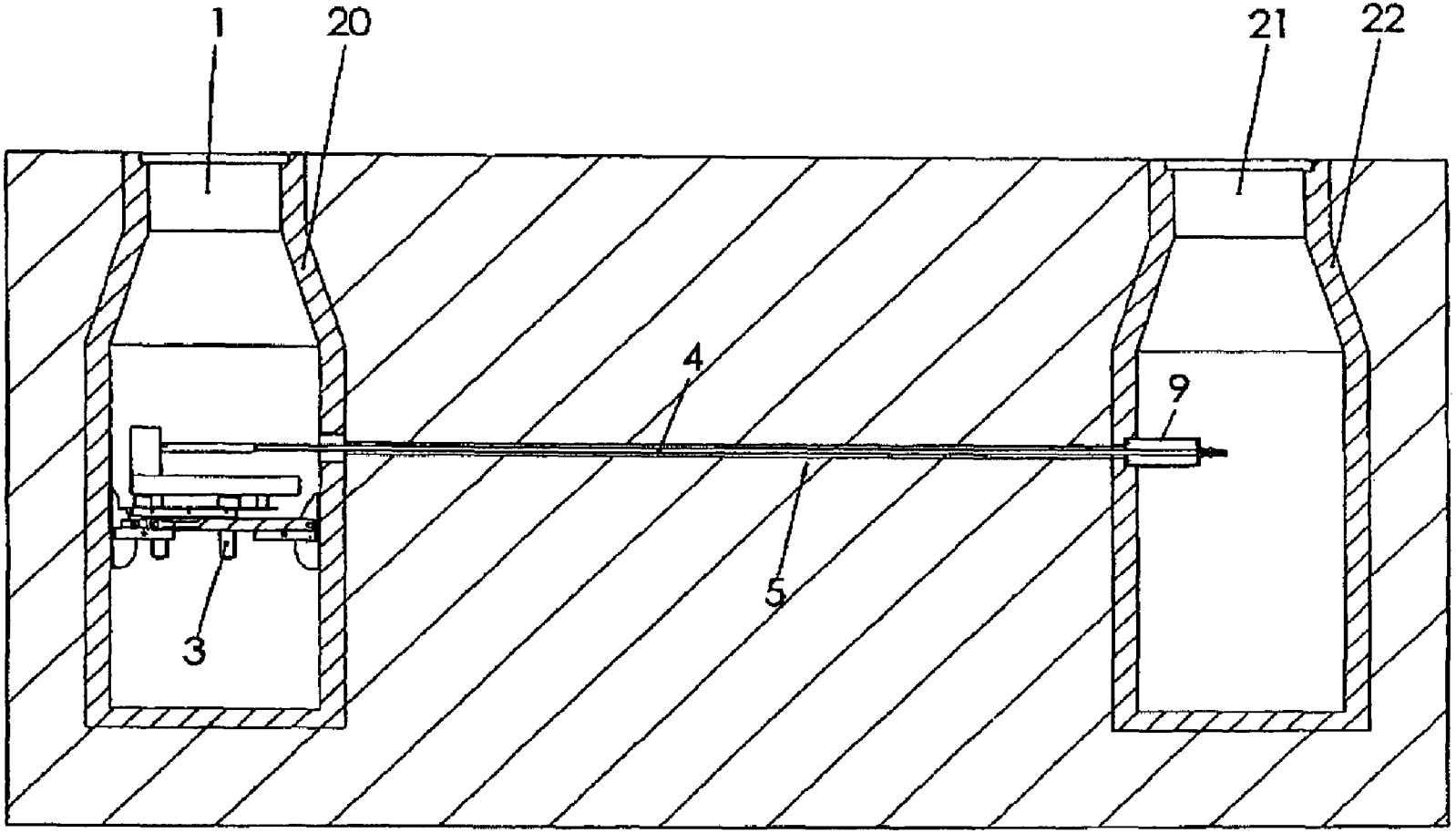
FIG. 6 shows a cutaway side view of a third method step in the further embodiment of the method according to the invention.

Retaining the same reference numbers for identical components, FIGS. 4 to 6 show a further embodiment of the method according to the invention. This embodiment is characterized by the fact that a core hole is also drilled in the starting shaft 1 in order to create a breach in the wall 20 surrounding the starting shaft 1. This breach can be created with the second drill head 9.

The second drill head 9 is then replaced by the first drill head 6, and a pilot bore is created from the starting shaft 1 to a target shaft 21. In doing so, the drill head 6 creates a breach through the wall 22 surrounding the target shaft 21 (cf. FIG. 5).

Following this, the drill head 6 is replaced in the target shaft 21 by a drill head 9. The latter is designed to create a smooth drilled hole in a wall and is able to produce a wall breach having a greater cross section than the wall breach created with the drill head 6. This drill head 9 is guided by pulling the rods back in the direction of advance counter to that of the first drill head 6, and it creates, in the wall 22, a breach with a regular shape and with the desired cross section (cf. FIG. 6).

What is claimed is:

1. A drilling method for creating an underground channel to a shaft, said method comprising the following steps:

drilling a channel through soil from a starting pit in a direction of the shaft using a first drill head, drilling through a wall of the shaft in said direction with the first drill head to create a breach in the wall, changing from the first drill head to a second drill head or drill arrangement in the shaft, and widening the breach in the wall by drilling in the opposite direction with the second drill head, wherein the widening step is terminated upon reaching a surface of the wall located outside in relation to an interior of the shaft.

2. The drilling method as claimed in claim 1, further comprising the step of retracting the second drill head into the shaft after termination of the widening step.

3. The drilling method as claimed in claim 1, further comprising the step of providing a transmitter on at least one of the first drill head and the second drill head to emit a position signal to a receiver, and controlling drilling parameters as a function of the position signal received by the receiver.

4. The drilling method as claimed in claim 1, further comprising the step of lining the breach in the wall after the widening step.

5. The method of claim 1 wherein the first drilling step involves the step of drilling a channel for a house service connection.

* * * * *